US008839904B2

(12) United States Patent
Chen

(10) Patent No.: US 8,839,904 B2
(45) Date of Patent: Sep. 23, 2014

(54) VARIABLE FREQUENCY HELMHOLTZ RESONATOR

(71) Applicant: Mann+Hummel Filter (Shanghai) Co. Ltd., Shanghai (CN)

(72) Inventor: Qiang Chen, Shanghai (CN)

(73) Assignee: Mann+Hummel Filter (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 13/973,029

(22) Filed: Aug. 22, 2013

(65) Prior Publication Data

US 2014/0060961 A1 Mar. 6, 2014

(30) Foreign Application Priority Data

Aug. 22, 2012 (CN) ..... 2012 2 0419822

(51) Int. Cl.
*F01N 1/02* (2006.01)

(52) U.S. Cl.
USPC ..... 181/197; 181/250

(58) Field of Classification Search
USPC ..... 181/197, 250, 266, 276, 273
See application file for complete search history.

(56) References Cited

U.S. PATENT DOCUMENTS

| | | | | |
|---|---|---|---|---|
| 5,189,266 | A * | 2/1993 | Sasaki et al. | 181/227 |
| 6,508,331 | B1 * | 1/2003 | Stuart | 181/250 |
| 6,698,390 | B1 * | 3/2004 | Kostun et al. | 123/184.57 |
| 6,792,907 | B1 * | 9/2004 | Kostun et al. | 123/184.57 |
| 6,848,410 | B2 * | 2/2005 | Hoffmann et al. | 123/184.57 |
| 7,077,093 | B2 * | 7/2006 | Koelmel et al. | 123/184.57 |
| 7,089,901 | B2 * | 8/2006 | Kino et al. | 123/184.57 |
| 7,255,197 | B2 * | 8/2007 | Horiko | 181/250 |
| 7,334,663 | B2 * | 2/2008 | Nakayama et al. | 181/276 |
| 7,337,877 | B2 * | 3/2008 | Goenka et al. | 181/250 |
| 7,690,478 | B2 * | 4/2010 | Kostun et al. | 181/250 |
| 2003/0230273 | A1 * | 12/2003 | Koelmel et al. | 123/184.57 |
| 2006/0236971 | A1 * | 10/2006 | Kanda et al. | 123/184.55 |

* cited by examiner

*Primary Examiner* — Forrest M Phillips

(57) ABSTRACT

A variable frequency Helmholtz resonant cavity includes a Helmholtz resonant cavity body, two Helmholtz resonant cavity pipes with different cross-sectional areas and lengths and a control valve plate. The Helmholtz resonant cavity body is connected with the main pipe of the intake system via the Helmholtz resonant cavity pipes, and the control valve plate is disposed at the location where the two Helmholtz resonant cavity pipes meet.

4 Claims, 1 Drawing Sheet

VARIABLE FREQUENCY HELMHOLTZ RESONATOR

CROSS REFERENCE TO RELATED APPLICATIONS

This application claims priority based on Chinese utility model application no. CN201220419822.X filed: Aug. 22, 2012.

TECHNICAL FIELD

The present disclosure relates to a Helmholtz resonant cavity, in particular to a variable frequency Helmholtz resonant cavity.

DESCRIPTION OF THE RELATED ART

Helmholtz resonant cavity is an effective method to eliminate low frequency components of noises in automobile intake systems. A Helmholtz resonant cavity branched on the main pipe of an automobile intake system can reduce the low frequency noise with certain frequencies in the automobile intake system.

The frequency of low frequency noise components of an automobile intake system is not constant, which would increase along with the increase of engine speed of rotation. Since current Helmholtz resonant cavities are only effective for certain frequencies, they are only effective at certain engine speed of rotation. To solve this problem, it is sometimes necessary to place a plurality of Helmholtz resonant cavities as branches to the main pipe of an automobile intake system, which leads to problems in cost and installation space.

SUMMARY OF THE INVENTION

The object of the present invention is to overcome the above drawbacks of the prior art by providing a variable frequency Helmholtz resonant cavity that saves cost, saves installation space, and improves muffling effect.

The object of the present invention utility model may be attained with the following technical solution:

A variable frequency Helmholtz resonant cavity, characterized in that it comprises a Helmholtz resonant cavity body, two Helmholtz resonant cavity pipes with different cross-sectional areas and lengths and a control valve plate, said Helmholtz resonant cavity body is connected with the main pipe of the intake system via the Helmholtz resonant cavity pipes, and said control valve plate is disposed at the location where the two Helmholtz resonant cavity pipes meet;

One of the Helmholtz resonant cavity pipes is open under the control of the control valve plate, thereby changing the cross-sectional area and length of the Helmholtz resonant cavity pipe, thereby adjusting the muffling frequency of the Helmholtz resonant cavity.

Said control valve plate includes the following ways of control: manual, electromagnetic or pressure control.

Compared with the prior art, the present utility model has the following advantages:

1. Saving cost. To reduce the low-frequency noise of an automobile intake system, a very large Helmholtz resonant cavity or a number of Helmholtz resonant cavities are needed, while the present invention only needs a relatively small Helmholtz resonant cavity to achieve very good effect of muffling low-frequency noise.

2. Saving installation space. The volume of a Helmholtz resonant cavity is typically very large. Given that the space of the automobile engine compartment is tight, there is typically no sufficient space for arranging a very large Helmholtz resonant cavity or a number of Helmholtz resonant cavities. As the present invention only needs a relatively small Helmholtz resonant cavity, the above problem is effectively solved.

3. Improving the muffling effect. Helmholtz resonant cavities according to the prior art are only effective at a specific frequency and the muffling effect is not ideal. The present invention can make one Helmholtz resonant cavity work at two frequencies, which effectively improves its muffling effect.

Figure 1:
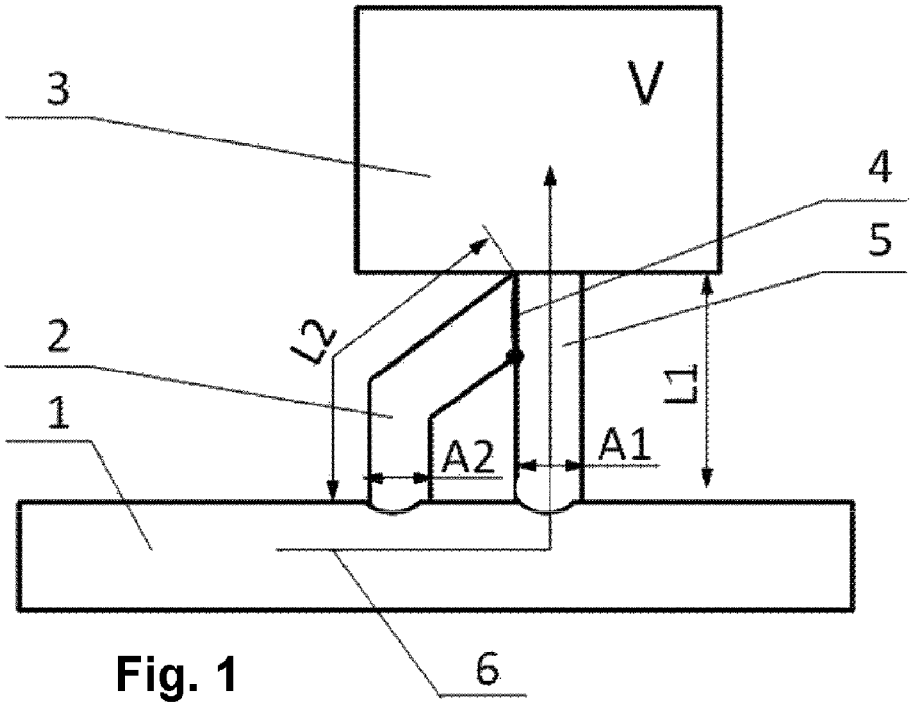
FIG. 1 illustrates one schematic structure of the present invention.
Figure 2:
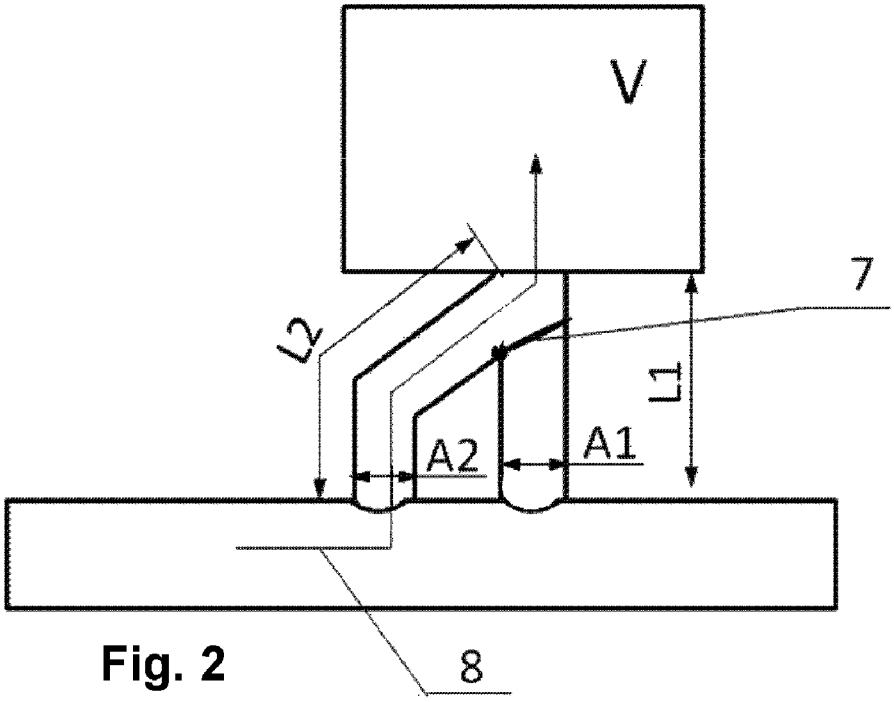
FIG. 2 illustrates another schematic structure of the present invention.

Wherein the numbers in FIG. 1 represent:

1. Main pipe of the automobile intake system, 2. Second Helmholtz resonant cavity pipe, 3. Helmholtz resonant cavity body, 4. First control valve plate position, 5. First Helmholtz resonant cavity pipe, 6. First air channel The numbers in FIG. 2 represent:

7. Second control valve plate position, 8. Second air channel

DETAILED DESCRIPTION OF THE PREFERRED EMBODIMENT

The preferred embodiment will be described in detail below with reference to the accompanying drawings and embodiments.

Embodiments

The preferred embodiment includes a first Helmholtz resonant cavity pipe 5, a second Helmholtz resonant cavity pipe 2, a control valve plate, and a Helmholtz resonant cavity body 3, and the Helmholtz resonant cavity pipe 5 and the second Helmholtz resonant cavity pipe 2 are connected with the main pipe of the automobile intake system 1, respectively. There is a control valve plate at the location where the Helmholtz resonant cavity pipe 5 and the second Helmholtz resonant cavity pipe 2 meet to control the opening and closing of the two pipes.

Working Principle:

Muffling Frequency of the Helmholtz Resonant Cavity:

$$f_0 = \frac{c}{2\pi}\sqrt{\frac{A}{VL}} \tag{1}$$

Wherein c is the sound velocity, A is the cross-sectional area of Helmholtz resonant cavity pipe, V is the volume of Helmholtz resonant cavity and l is the length of Helmholtz resonant cavity pipe.

According to the equation above, the muffling frequency may be adjusted just by adjusting the cross-sectional area and length of the Helmholtz resonant cavity pipe. The present invention connects the Helmholtz resonant cavity with the main pipe of an automobile intake system through two pipes and controls one of the pipes to open via the valve plate to change the cross-sectional area and length of Helmholtz resonant cavity pipes, thereby adjusting the muffling frequency of Helmholtz resonant cavity.

When the control valve plate is at the first control valve plate position 4 in FIG. 1, this variable frequency Helmholtz resonant cavity forms the first air channel 6, and at this moment, the effective pipe length of the Helmholtz resonant cavity is $L_1$, and the effective pipe cross-sectional area is $A_1$. According to the Equation (1), the muffling frequency of the Helmholtz resonant cavity at this moment is $$f_1 = \frac{c}{2\pi}\sqrt{\frac{A_1}{VL_1}}.$$

When the control valve plate is at the second control valve plate position 7 in FIG. 2, this variable frequency Helmholtz resonant cavity forms the second air channel 8, and at this moment, the effective pipe length of the Helmholtz resonant cavity is $L_2$, and the effective pipe cross-sectional area is $A_2$. According to the Equation (1), the muffling frequency of the Helmholtz resonant cavity at this moment is $$f_2 = \frac{c}{2\pi}\sqrt{\frac{A_2}{VL_2}}.$$

Since the two pipes have different lengths and cross-sectional areas, the variable frequency Helmholtz resonant cavity has different muffling frequencies under the above two states, thereby achieving the effect of changing the muffling frequency of the Helmholtz resonant cavity.

The invention claimed is:

1. A variable frequency Helmholtz resonant cavity resonator, comprising:

a Helmholtz resonant cavity body enclosing a resonant cavity therein;

two Helmholtz resonant cavity pipes;

wherein each pipe connected at first end to an automotive intake system, wherein each pipe is connected at an opposing second end to the resonant cavity in the body;

wherein a first one of said two Helmholtz resonant cavity pipes has a first length along its length from its first end to its opposing second end;

wherein a second one of said two Helmholtz resonant cavity pipes has a second length along its length from its first end to its opposing second end;

wherein the first one of said two Helmholtz resonant cavity pipes has an interior air channel with a first cross sectional area;

wherein the second one of said two Helmholtz resonant cavity pipes has an interior air channel with a second cross sectional area;

wherein said first and second cross sectional areas are different;

wherein said first and second lengths are different;

a control valve plate arranged at the second ends of the first and second Helmholtz resonant cavity pipes, the control valve plate operable between a first position and a second position;

wherein in the first position, the control valve plate closes the air channel of the first Helmholtz resonant cavity pipe and opens the air channel of the second Helmholtz resonant cavity pipe to communicate with the resonant cavity of the Helmholtz resonant cavity body;

wherein in the second position, the control valve plate closes the air channel of the second Helmholtz resonant cavity pipe and opens the air channel of the first Helmholtz resonant cavity pipe to communicate with the resonant cavity of the Helmholtz resonant cavity body;

wherein changing the position of the control valve plate between the first and the second position changes effective cross-sectional area and effective length of Helmholtz resonant cavity pipe fluidically connecting the resonant cavity with the intake system, thereby adjusting the muffling frequency of the Helmholtz resonator.

2. The variable frequency Helmholtz resonant cavity resonator according to claim 1, wherein the second end of the second Helmholtz resonant cavity pipe connects to the first Helmholtz resonant cavity pipe near the second end of the first Helmholtz resonant cavity pipe;

wherein the second end of the first Helmholtz resonant cavity pipe connects to the resonant cavity of the resonator.

3. The variable frequency Helmholtz resonant cavity resonator according to claim 2, wherein the control valve plate is arranged at the second ends of the first and second Helmholtz resonant cavity pipes.

4. The variable frequency Helmholtz resonant cavity resonator according to claim 1, wherein the control valve plate is operated between the first to the second position by an any of: manual control, electromagnetic control or pressure control.

* * * * *